US008643314B2

(12) United States Patent
Touchi

(10) Patent No.: US 8,643,314 B2
(45) Date of Patent: Feb. 4, 2014

(54) PARTICLE ACCELERATOR AND CHARGED PARTICLE BEAM IRRADIATION APPARATUS INCLUDING PARTICLE ACCELERATOR

(75) Inventor: Yutaka Touchi, Niihama (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/467,400

(22) Filed: May 9, 2012

(65) Prior Publication Data

US 2012/0286703 A1 Nov. 15, 2012

(30) Foreign Application Priority Data

May 9, 2011 (JP) ..... 2011-104329

(51) Int. Cl.
*H05H 15/00* (2006.01)

(52) U.S. Cl.
USPC ..... 315/503; 315/500; 315/501; 315/502; 315/504; 315/505

(58) Field of Classification Search
USPC ..... 315/500–507; 313/62
See application file for complete search history.

(56) References Cited

U.S. PATENT DOCUMENTS

| | | | | |
|---|---|---|---|---|
| 2,860,313 | A * | 11/1958 | Israel | 336/110 |
| 5,661,366 | A * | 8/1997 | Hirota et al. | 315/5.41 |
| 7,634,062 | B2 * | 12/2009 | Tanaka et al. | 378/137 |
| 7,696,847 | B2 * | 4/2010 | Antaya | 335/216 |
| 7,741,781 | B2 * | 6/2010 | Nagayama et al. | 315/5.41 |
| 7,952,460 | B2 * | 5/2011 | Joehren et al. | 336/200 |
| 8,003,964 | B2 * | 8/2011 | Stark et al. | 250/505.1 |
| 8,089,222 | B2 * | 1/2012 | Oki et al. | 315/500 |
| 2009/0140671 | A1 * | 6/2009 | O'Neal et al. | 315/502 |
| 2010/0060206 | A1 * | 3/2010 | Oki et al. | 315/503 |
| 2011/0182410 | A1 * | 7/2011 | Balakin | 378/65 |

FOREIGN PATENT DOCUMENTS

| | | |
|---|---|---|
| JP | 55-001024 | 1/1980 |
| JP | 63-138697 | 6/1988 |
| JP | 07-006900 | 1/1995 |
| JP | 10-270200 | 10/1998 |
| JP | 2004-313314 | 11/2004 |
| JP | 2006-142315 | 6/2006 |

OTHER PUBLICATIONS

T. Kurita et al, An improvement of matching circuit of RF kicker electrodes, Proceedings of EPAC 2006 Edinburg Scotland, T12 Beam Inejction p. 1771-1773.*

International Search Report dated Jul. 10, 2012 for corresponding International Application No. PCT/JP2012/059585.

Vladimir Anferov, "Energy degrader optimization for medical beam lines", Nuclear Instruments and Methods in Physics Research A, 2003, vol. 496, p. 222-227, cover page.

* cited by examiner

*Primary Examiner* — Daniel Cavallari
*Assistant Examiner* — Srinivas Sathiraju
(74) *Attorney, Agent, or Firm* — Squire Sanders (US) LLP

(57) ABSTRACT

A particle accelerator that is a synchrocyclotron accelerating charged particles and which includes an acceleration electrode that accelerates the charged particles; a high frequency power source that supplies the electric power to the acceleration electrode; a control unit that adjusts the frequency of the electric power supplied from the high frequency power source based on energy of the charged particle which is accelerated; and a matching circuit that has a coil and a capacitor, and performing impedance matching between the acceleration electrode and the high frequency power source, wherein the matching circuit has an inductance adjustment unit electrically adjusting the inductance of the coil.

3 Claims, 2 Drawing Sheets

PARTICLE ACCELERATOR AND CHARGED PARTICLE BEAM IRRADIATION APPARATUS INCLUDING PARTICLE ACCELERATOR

RELATED APPLICATION

Priority is claimed to Japanese Patent Application No. 2011-104329, filed May 9, 2011, the entire content of which is incorporated herein by reference.

BACKGROUND

1. Technical Field

The present invention relates to a particle accelerator and a charged particle beam irradiation apparatus including the particle accelerator.

2. Description of the Related Art

A cyclotron as an accelerator accelerating charged particles is known. The charged particles accelerated in the cyclotron are, for example, used in proton beam therapy equipment in which the charged particles are emitted to a tumor of a cancer patient to treat the cancer. In addition, the charged particle accelerated in the cyclotron is used in a radioisotopes manufacturing apparatus which manufactures radioisotopes that are a raw material of radioactive drugs by irradiating a target material.

Acceleration electrodes W-shaped electrodes) for accelerating the charged particles, and electromagnets generating a magnetic field in the cyclotron are disposed inside the cyclotron. High frequency electric power is supplied from a high frequency power source (several tens of MHz to several hundreds of MHz) to the acceleration electrode.

In addition, the control of each part is performed on the assumption that a period (the time required for one revolution) of the charged particle which is accelerated in a spiral orbit inside the cyclotron, becomes constant in the cyclotron. Then, electric power having a frequency corresponding to the revolution period of the charged particle is supplied to the acceleration electrode. In other words, during the operation of the cyclotron, the frequency of the electric power supplied to the acceleration electrode is controlled so as to always be constant.

In addition, a matching circuit is disposed between the high frequency power source and the acceleration electrode. The matching circuit has a function of performing the impedance matching between the high frequency power source and the acceleration electrode. Unless there is the impedance matching between the high frequency power source that is the output side and the acceleration electrode that is input side, loss of the high frequency current that is transmitted to the acceleration electrode becomes large, and distortion and degradation of the high frequency voltage can occur. Thus, since a reflective wave is generated and superimposed in the transmitting path of the high frequency current, there is a problem in that the high frequency current is a standing wave and becomes an impediment. Accordingly the impedance matching is achieved using the matching circuit so that the occurrence of problems that could be an impediment or the like can be avoided. The matching circuit described above includes a coil as an inductance element and a capacitor as a capacitance element.

SUMMARY

According to one example of the invention, there is provided a particle accelerator that is a synchrocyclotron accelerating charged particles that includes an acceleration electrode that accelerates the charged particles; a high frequency power source that supplies the electric power to the acceleration electrode; a control unit that adjusts the frequency of the electric power supplied from the high frequency power source based on energy of the charged particles which are accelerated; and a matching circuit that has a coil and a capacitor, and performing impedance matching between the acceleration electrode and the high frequency power source. The matching circuit has an inductance adjustment unit electrically adjusting the inductance of the coil.

According to another example of the invention, there is provided a charged particle beam irradiation apparatus including the synchrocyclotron according to the above embodiment, wherein the charged particle beam emitted from the synchrocyclotron is irradiated to a body.

DETAILED DESCRIPTION

Figure 1:
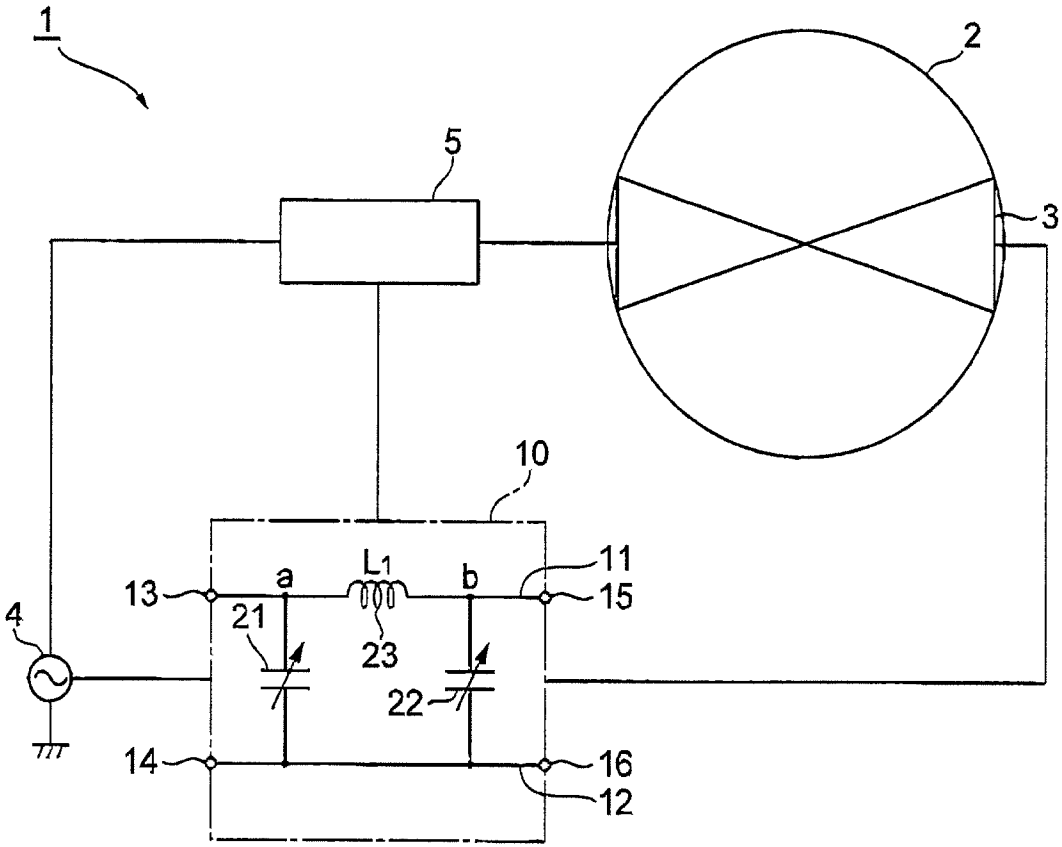
FIG. 1 is a schematic block diagram illustrating a matching circuit of a synchrocyclotron according to an embodiment of the invention.

If energy of a charged particle that is retrieved from a cyclotron is to be set (changed), it is necessary to change the size of the magnetic field generated by an electromagnet disposed inside the cyclotron. In addition, when the size of the magnetic field is changed due to the electromagnet, the frequency of the electric power supplied to the acceleration electrode is also required to be changed accordingly. Thus, when the frequency of the electric power supplied to the acceleration electrode is also changed, constants (value of self-inductance L of a coil and an electrostatic capacity C of a capacitor) of the matching circuit are also required to be changed.

In the cyclotron, according to the retrieving energy of the charged particle, the size of the magnetic field generated by the electromagnet before the operation, the frequency of the current supplied to the acceleration electrode, the constants of the matching circuit and the like are correctly set. Thus, since the values set before operation do not change the energy of the charged particle that is retrieved during the operation, high responsiveness is not required in the speed that changes the constant of the matching circuit. Accordingly, as an initial setting, the capacitor in the matching circuit is mechanically adjusted (adjusting a distance between two sheets electrodes in the capacitor) so that the circuit constants are adjusted.

The synchrocyclotron (the accelerator) is developed besides the cyclotron. The control of the each part is performed on the assumption that the period of the charged particle that is accelerated in a spiral orbit is constant; however, in practice, the higher the energy is, the heavier the mass of the charged particle becomes and then a period delay occurs in the cyclotron. Meanwhile, the synchrocyclotron adjusts (decreases) the frequency of the current supplied to the acceleration electrode in order to accommodate the period delay.

In the synchrocyclotron, the time required for one revolution of the charged particle is several tens of nanoseconds. Thus, the frequency adjustment of the current supplied to a D-shaped electrode to accommodate the period delay of the charged particle is required to be performed with a high response speed (in a short time). Accordingly, the adjustment of the constant of the matching circuit is required to be performed with a high response speed.

However, in the adjustment by the capacitor of the related art, since this is the mechanical adjustment method that is a distance adjustment between electrodes, there is a limit to shorten the adjustment time and there is a problem that it cannot correspond to the frequency adjustment of the current in the short time in the synchrocyclotron that performs rapid cycling.

The invention is made in view of the circumstance described above and it is desirable to provide a particle accelerator which includes an adjustment circuit that can shorten the adjustment time when the impedance matching between an acceleration electrode accelerating a charged particle and a high frequency power source supplying the electric power to the acceleration electrode is performed, and a charged particle beam irradiation apparatus using the particle accelerator.

According to the invention, in the synchrocyclotron, since the adjustment of the constant of the matching circuit that performs the impedance matching between the acceleration electrode and the high frequency power source may be electrically performed, the adjustment can be performed with a high response speed (in a short time) compared to the related art. For example, it is preferable that the matching circuit adjusts the inductance of the coil according to the adjustment of the frequency of the electric power supplied from the high frequency power source.

In addition, according to the charged particle beam irradiation apparatus including the synchrocyclotron described above, the charged particle beam having high energy can be stably retrieved from the synchrocyclotron so that the beam having high energy can be stably irradiated.

Here, as a specific configuration of the synchrocyclotron that achieves the function described above, the inductance adjustment unit may include a circular ferrite adjusting the inductance of the coil, a bias winding wound around the ferrite, a bias power source supplying the bias current to the bias winding, and a bias current adjustment unit increasing or decreasing the bias current supplied to the bias winding. According to the particle accelerator having the configuration described above, the increasing and decreasing of the current supplied to the winding of the coil is adjusted so that the magnetic permeability $\mu$ of the ferrite is changed and the constant of the matching circuit can be adjusted in a short time.

According to the invention described above, when the impedance matching between the acceleration electrode for accelerating the charged particle and the high frequency power source supplying the electric power to the acceleration electrode is performed, the adjustment time can be shortened.

Hereinafter, a preferred example of a particle accelerator according to an example of the invention is described with reference to the drawings. In addition, in the description of the drawings, the same or equivalent elements assign the same reference numerals and duplicate description is omitted. Moreover, the positional relationship such as up and down, left and right, or the like is based on the positional relationship in the drawings. In one example, description is given in a case where the particle accelerator is a synchrocyclotron.

FIG. 1 is a schematic block diagram illustrating the matching circuit of the synchrocyclotron according to one example of the invention. A synchrocyclotron 1 is for generating a proton beam (a charged particle beam) and accelerates ions (cations of the hydrogen) supplied from an ion source (not shown) inside a vacuum chamber 2 so as to generate and emit the proton beam.

The synchrocyclotron 1 includes a pair of iron cores (yokes, not shown) arranged in vertical opposition, and an acceleration electrode (a D-shaped electrode) 3 where a high frequency electric power is supplied. A magnetic field is formed inside the vacuum chamber 2 by the iron core, the ions are accelerated in a spiral and the speed thereof increases as the radius of the revolution orbit increases.

In addition, the synchrocyclotron 1 includes a high frequency power source 4, a control unit 5 and a matching circuit 10. The high frequency power source 4 is an electric power source for supplying high frequency electric power to the acceleration electrode 3. The control unit 5 adjusts the frequency of the electric power supplied from the high frequency power source 4 based on the energy of the ion accelerated with the acceleration electrode 3. The control unit 5 is electrically connected to the acceleration electrode 3, the high frequency power source 4 and the matching circuit 10. The matching circuit 10 functions as a matching circuit that performs the impedance matching between the high frequency power source 4 and the acceleration electrode 3.

Input terminals 13 and 14 of the matching circuit 10 are connected to the high frequency power source 4 and output terminals 15 and 16 of the matching circuit 10 are connected to the acceleration electrode 3. A conducting wire 11 which electrically connects the input terminal 13 and the output terminal 15, and a conducting wire 12 which electrically connects the input terminal 14 and the output terminal 16 are disposed in the matching circuit 10. In addition, the matching circuit 10 includes a variable capacitor 21 and a variable capacitor 22 which are connected in parallel between the conducting wires 11 and 12, the variable capacitor 21 is connected to the input terminals 13 and 14 side, and the variable capacitor 22 is connected to the output terminals 15 and 16 side.

Here, the matching Circuit 10 includes a coil 23 which is connected in series to the conducting wire 11, and is configured such that an inductance L1 of the coil 23 is electrically adjusted and thereby impedance Z4 of the high frequency power source 4 and impedance Z3 of the acceleration electrode 3 can be matched.

Figure 2:
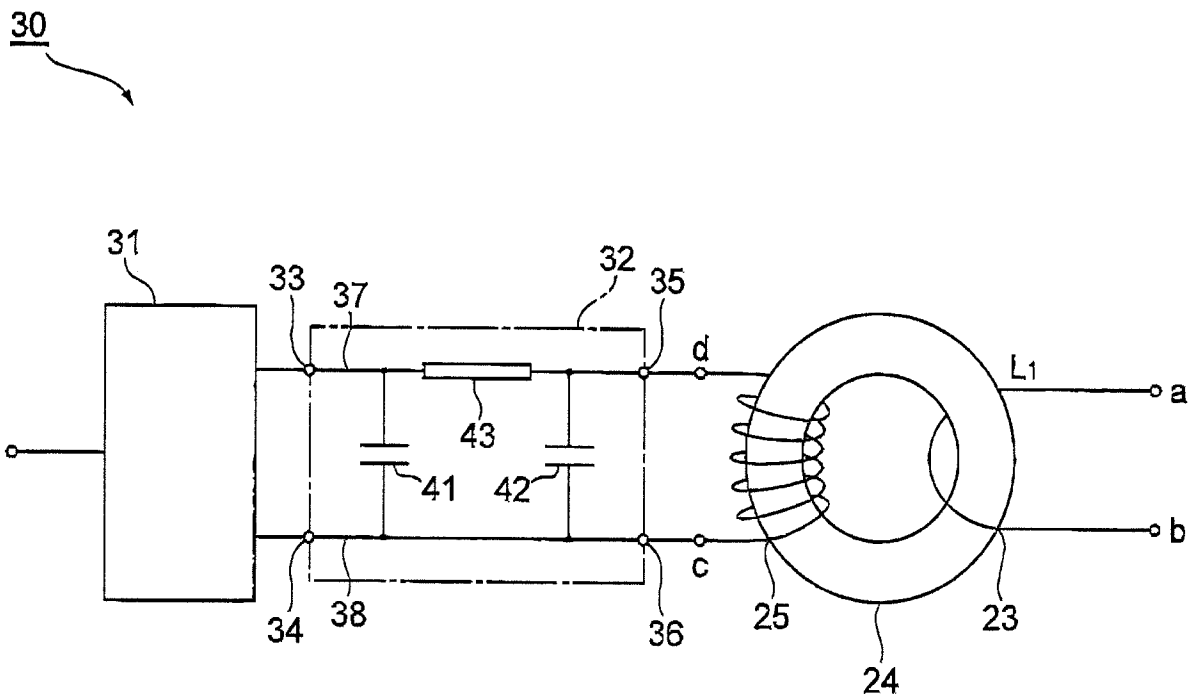
FIG. 2 is a schematic block diagram illustrating an inductance adjustment unit that can change an inductance of a coil of the matching circuit shown in FIG. 1.

FIG. 2 is a schematic block diagram illustrating the inductance adjustment unit that can change the inductance of the coil of the matching circuit shown in FIG. 1. The matching circuit 10 includes an inductance adjustment unit 30 electrically adjusting the inductance L1 of the coil 23. The inductance adjustment unit 30 includes a circular ferrite (a magnetic body) 24 for adjusting the inductance L1 of the coil 23, the bias winding 25 wound around the ferrite 24, a bias power source 31 supplying a bias current to the bias winding 25, and a RF filter 32 where the high frequency electric power transmitted to the ferrite 24 is not transmitted to the bias power source 31.

The coil (the RF coil) 23 is wound around the ferrite 24 with ½ turn. Input terminals 33 and 34 of the RF filter 32 is connected to the bias power source 31 and output terminals 35 and 36 of the RF filter 32 are connected to the bias winding 25. A conducting wire 37 which electrically connects the input terminal 33 and the output terminal 35, and a conducting wire 38 which electrically connects the input terminal 34 and the output terminal 36 are disposed in the RF filter 32. In addition, the inductance adjustment unit 30 includes capacitors 41 and 42 which are connected in parallel between conducting wires 37 and 38. The capacitor 41 is connected to the input terminals 33 and 34 side, and the capacitor 42 is connected to the output terminals 35 and 36 side. In addition, a filter 43 is connected in series to the conducting wire 37 of the RF filter 32.

The bias current output from the bias power source 31 is supplied to the bias winding 25. The bias power source 31 has a function (the bias current adjustment unit) for increasing or decreasing of the bias current supplied to the bias winding 25. The bias power source 31 increases or decreases the bias current supplied to the bias winding 25 and a magnetic permeability μ of the ferrite 24 is changed so that the inductance L1 of the coil 23 of the matching circuit 10 can be adjusted and the constant of the matching circuit 10 can be adjusted in a short time. Here, the constant of the matching circuit 10 refers to inductance L of the coil 23 or capacity of the capacitors 21 and 22. In the bias power source 31, for example, the bias current is increased so that the magnetic permeability μ of the ferrite 24 is lowered and the inductance L1 of the coil 23 is decreased.

As described above, according to the synchrocyclotron 1 of one example, since the constant of the matching circuit 10 can be electrically adjusted, the constant thereof can be adjusted with high response speed (for example, 1 ms) compared to the related art. In the synchrocyclotron 1, the impedance matching between the acceleration electrode 3 and the high frequency power source 4 is performed by the matching circuit 10, and it is possible to suitably adjust the frequency adjustment of the high frequency electric power supplying to the acceleration electrode 3. In the synchrocyclotron 1, the frequency of the electric power supplying to the acceleration electrode 3 is decreased. Accordingly, the period delay caused by the increased energy of the charged particle can be avoided and the charged particle can be preferably accelerated so that it is possible to obtain beam current having the high intensity.

In addition, the synchrocyclotron 1 of one example can be for example, employed to proton beam therapy equipment (a charged particle beam irradiation apparatus) that is applied in cancer therapy. The proton beam therapy equipment includes the synchrocyclotron 1 and irradiates the proton beam emitted from the synchrocyclotron 1 to the tumor (the irradiated body) inside the body of the patient.

According to the proton beam therapy equipment including the synchrocyclotron 1 of one example, since the proton beam having high energy can be stably retrieved from the synchrocyclotron 1, the beam having high energy can be stably irradiated.

Hereinabove, one example of the invention is described in detail; however, the invention is not limited to the example. The particle beam (the charged particles) is not limited to the proton beam, and a proton beam (a heavy particle beam) or the like may be applied.

It should be understood that the invention is not limited to the above-described example, but may be modified into various forms on the basis of the spirit of the invention. Additionally, the modifications are included in the scope of the invention.

What is claimed is:

1. A particle accelerator that is a synchrocyclotron accelerating charged particles comprising:

an acceleration electrode that accelerates the charged particles;

a high frequency power source that supplies the electric power to the acceleration electrode;

a control unit that adjusts the frequency of the electric power supplied from the high frequency power source based on energy of the charged particles which are accelerated; and a matching circuit that has a coil and a capacitor, and performs impedance matching between the acceleration electrode and the high frequency power source, wherein the matching circuit has an inductance adjustment unit electrically adjusting the inductance of the coil, wherein the control unit is electrically connected to the acceleration electrode, the high frequency power source, and the matching circuit, and wherein the matching circuit adjusts the inductance of the coil according to the adjustment of the frequency of the electric power supplied from the high frequency power source.

2. A particle accelerator that is a synchrocyclotron accelerating charged particles comprising:

an acceleration electrode that accelerates the charged particles;

a high frequency power source that supplies the electric power to the acceleration electrode;

a control unit that adjusts the frequency of the electric power supplied from the high frequency power source based on energy of the charged particles which are accelerated; and a matching circuit that has a coil and a capacitor, and performs impedance matching between the acceleration electrode and the high frequency power source, wherein the matching circuit has an inductance adjustment unit electrically adjusting the inductance of the coil, wherein the control unit is electrically connected to the acceleration electrode, the high frequency power source, and the matching circuit, and wherein the inductance adjustment unit includes a circular ferrite adjusting the inductance of the coil, a bias winding wound around the ferrite, a bias power source supplying the bias current to the bias winding, and a bias current adjustment unit increasing or decreasing the bias current supplied to the bias winding.

3. A charged particle beam irradiation apparatus according to claim 1 or 2, wherein the charged particle beam emitted from the synchrocyclotron is irradiated to an irradiated body.

* * * * *